US010804666B2

(12) United States Patent
Mears et al.

(10) Patent No.: US 10,804,666 B2
(45) Date of Patent: Oct. 13, 2020

(54) TOOL DEVICE FOR GENERATING A CURVED TERMINAL

(71) Applicants: Andrew R. Mears, La Valle, WI (US); Jack Ray Klopfenstein, Brodhead, WI (US)

(72) Inventors: Andrew R. Mears, La Valle, WI (US); Jack Ray Klopfenstein, Brodhead, WI (US)

( * ) Notice: Subject to any disclaimer, the term of this patent is extended or adjusted under 35 U.S.C. 154(b) by 0 days.

(21) Appl. No.: 15/343,187

(22) Filed: Nov. 3, 2016

(65) Prior Publication Data

US 2019/0081447 A1 Mar. 14, 2019

(51) Int. Cl.

| | |
|---|---|
| ***H01R 43/28*** | (2006.01) |
| ***H01R 43/05*** | (2006.01) |
| ***B21F 1/00*** | (2006.01) |
| ***B21F 1/06*** | (2006.01) |
| *H01R 4/16* | (2006.01) |

(52) U.S. Cl.

CPC ..... *H01R 43/05* (2013.01); *B21F 1/002* (2013.01); *B21F 1/06* (2013.01); *H01R 43/28* (2013.01); *H01R 4/16* (2013.01)

(58) Field of Classification Search

CPC ..... H01R 4/16; H01R 43/05; B25B 33/00; B25B 15/00; B25B 15/001; B25B 23/08; B25B 23/10; B25B 23/101; B25F 1/00; B21F 1/002

USPC ..... D8/82–87; 81/451, 452, 458; 140/102.5, 140/123

See application file for complete search history.

(56) References Cited

U.S. PATENT DOCUMENTS

| | | | | |
|---|---|---|---|---|
| D278,027 | S * | 3/1985 | Tang | D8/82 |
| 4,539,873 | A * | 9/1985 | Freed | B25F 1/003 29/229 |
| 6,164,172 | A * | 12/2000 | Huang | B25B 9/00 7/165 |
| 8,621,961 | B2 * | 1/2014 | Burch | B25B 15/02 7/107 |
| 2008/0243133 | A1 * | 10/2008 | Heinz | A61B 17/7082 606/104 |
| 2009/0133705 | A1 * | 5/2009 | Smith | A24F 13/24 131/255 |
| 2012/0312413 | A1 * | 12/2012 | Bullard | B21F 1/002 140/710 |

OTHER PUBLICATIONS

Plier, Wikipedia article, https://en.wikipedia.org/wiki/Pliers (Year: 2015).*

* cited by examiner

*Primary Examiner* — Pradeep C Battula
(74) *Attorney, Agent, or Firm* — David J. Archer

(57) ABSTRACT

A tool device is disclosed for generating a curved terminal from an insulation stripped end of an electrical wire. The tool device includes a first member having a first and a second end the first member having a longitudinal axis. A second member is disposed adjacent to the first member, the second member having a first and a second extremity. The second member defines a further longitudinal axis which is disposed substantially parallel to and spaced from the longitudinal axis of the first member. The arrangement is such that a space is defined between the first member and the second member for the reception therein of the insulation stripped end of the electrical wire. The curved terminal is generated during relative movement of the axes around the insulation stripped end of the electrical wire.

12 Claims, 9 Drawing Sheets

TOOL DEVICE FOR GENERATING A CURVED TERMINAL

FIELD OF THE INVENTION

The present invention relates to a tool device for generating a curved terminal.

More specifically, the present invention relates to a tool device for generating a curved terminal from an insulation stripped end of an electrical wire.

BACKGROUND OF THE INVENTION

During electrical wiring of a house or other building, considerable time is taken trying to bend the insulation stripped end of a wire with flat or long-nose pliers or the like such that the bent wire will receive an electrical anchoring screw so that the bent wire terminal can be electrically disposed adjacent to the electrical outlet or electrical switch. The present invention provides a unique tool device that enables a user of the tool to rapidly and easily generate a curved loop on the wire for the reception therein of the anchoring screw.

Therefore, it is a primary feature of the present invention to provide a tool device for generating a curved terminal that overcomes the problems associated with the prior art arrangements.

Another feature of the present invention is the provision of a tool device for generating a curved terminal that is easy to use.

A further feature of the present invention is the provision of a tool device for rapidly generating a curved terminal.

Other features and advantages of the present invention will be readily apparent to those skilled in the art by a consideration of the detailed description of a preferred embodiment of the present invention contained herein.

SUMMARY OF THE INVENTION

The present invention relates to a tool device for generating a curved terminal from an insulation stripped end of an electrical wire. The tool device includes a first member having a first and a second end, the first member having a longitudinal axis. A second member is disposed adjacent to the first member, the second member having a first and a second extremity. The second member defines a further longitudinal axis which is disposed substantially parallel to and spaced from the longitudinal axis of the first member. The arrangement is such that a space is defined between the first member and the second member for the reception therein of the insulation stripped end of the electrical wire. The curved terminal is generated during relative movement of the axes around the insulation stripped end of the electrical wire in a plane extending through the insulation stripped end of the electrical wire and substantially normal to the axes.

In a more specific embodiment of the present invention, the first member includes a portion of cylindrical configuration disposed adjacent to and spaced from the second member. The portion is disposed between the first and the second end of the first member.

Also, the second member includes a further portion of cylindrical configuration disposed adjacent to and spaced from the first member. The further portion is disposed between the first and the second extremity of the second member.

More specifically, the portion has a first diameter and the further portion has a second diameter and the first and the second diameters are different relative to each other.

In another embodiment of the present invention, the first diameter is the same as the second diameter.

Preferably, the first member and the second member are fabricated from steel.

In a preferred embodiment of the present invention, a handle is secured to the first member and the second member such that when the handle is rotated, the first member and second member move relative to each other such that the insulation stripped end of the electrical wire disposed in the space between the first member and the second member is bent so that the curved terminal is generated.

Additionally, the handle is secured to the first end of the first member and the first extremity of the second member.

In another embodiment of the present invention, the first member defines a plurality of cylindrical portions disposed between the ends of the first member. Each of the plurality of cylindrical portions has a different diameter and the plurality of cylindrical portions are disposed axially spaced relative to each other and coaxially relative to the longitudinal axis. The arrangement is such that the space between the first and second members accommodates the insulation stripped ends of various gauge electrical wires.

In yet another embodiment of the present invention, the second member defines a plurality of cylindrical further portions disposed between the extremities of the second member. Each of the plurality of cylindrical further portions has a different diameter. The plurality of cylindrical further portions are disposed axially spaced relative to each other and coaxially relative to the further longitudinal axis. The arrangement is such that the space between the first member and the second member accommodates the insulation stripped ends of various gauge electrical wires.

In a further embodiment of the present invention, the first member defines a surface which is roughened so that the surface of the first member tends to grip the insulation stripped end of the electrical wire during the generation of the curved terminal.

In still a further embodiment of the present invention, the second member defines a face which is roughened so that the face of the second member tends to grip the insulation stripped end of the electrical wire during the generation of the curved terminal.

Also, in another embodiment of the present invention, the first member defines a surface which is roughened and the second member defines a face which is roughened so that the surface and the face grip the insulation stripped end of the electrical wire during the generation of the curved terminal.

Many modifications and variations of the present invention will be readily apparent to those skilled in the art by a consideration of the detailed description contained hereinafter taken in conjunction with the annexed drawings which show a preferred embodiment of the present invention. However, such modifications and variations fall within the spirit and scope of the present invention as defined by the appended claims.

BRIEF DESCRIPTION OF THE DRAWINGS

Similar reference characters refer to similar parts throughout the various views and embodiments of the present invention as shown in the drawings but with a suffix added thereto.

DETAILED DESCRIPTION OF THE DRAWINGS

Figure 1:
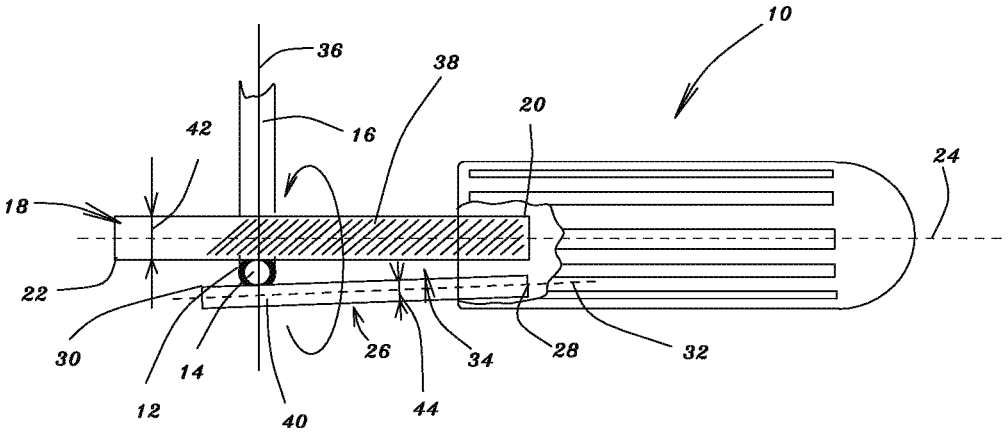
FIG. 1 is a top plan view of a tool device according to the present invention for generating a curved terminal from an insulation stripped end of an electrical wire.

FIG. 1 is a side elevational view partially in section of a tool device generally designated 10 according to the present invention for generating a curved terminal generally designated 12 from an insulation stripped end 14 of an electrical wire 16.

As shown in FIG. 1, the tool device 10 includes a first member generally designated 18 having a first and a second end 20 and 22 respectively, the first member 18 having a longitudinal axis 24. A second member generally designated 26 is disposed adjacent to the first member 18, the second member 26 having a first and a second extremity 28 and 30 respectively. The second member 26 defines a further longitudinal axis 32 which is disposed substantially parallel to and rigidly spaced from the longitudinal axis 24 of the first member 18. The arrangement is such that a space generally designated 34 is defined between the first member 18 and the second member 26 for the reception therein of the insulation stripped end 14 of the electrical wire 16. The curved terminal 12 is generated during relative movement of the axes 24 and 32 around the insulation stripped end 14 of the electrical wire 16. More specifically, the terminal 12 is generated during relative movement of the axes 24 and 32 around the insulation stripped end 14 of the electrical wire 16 in a plane 36 which extends through the insulation stripped end 14 of the electrical wire 16 and substantially normal to the axes 24 and 32.

In a more particular embodiment of the present invention, the first member 18 includes a portion 38 which is disposed adjacent to and spaced from the second member 26, the portion 38 being of cylindrical configuration. The portion 38 is disposed between the first and the second end 20 and 22 respectively of the first member 18.

Also, the second member 26 includes a further portion 40 which is disposed adjacent to and spaced from the first member 18, the further portion 40 being of cylindrical configuration. The further portion 40 is disposed between the first and the second extremity 28 and 30 of the second member 26.

More specifically, the portion 38 and the further portion 40 are disposed adjacent to each other.

Moreover, the portion 38 has a first diameter 42 and the further portion 40 has a second diameter 44 with the first and the second diameters 42 and 44 being different relative to each other.

Figure 2:
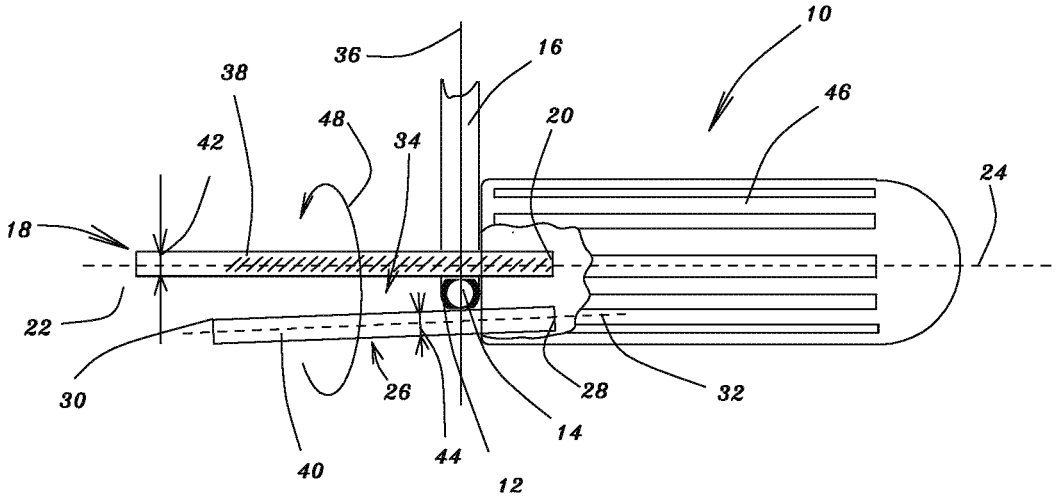
FIG. 2 is a similar view to that shown in FIG. 1 but shows another embodiment of the present invention.

FIG. 2 is a similar view to that shown in FIG. 1 but shows another embodiment of the present invention. As shown in FIG. 2, the first diameter 42 is the same as the second diameter 44.

Preferably, the first member 18 and the second member 26 are fabricated from steel.

In a preferred embodiment of the present invention, a handle 46 is secured to both the first member 18 and the second member 26 such that when the handle 46 is rotated as indicated by the arrow 48, the first member 18 and second member 26 move relative to each other as indicated by the arrow 48 such that the insulation stripped end 14 of the electrical wire 16 disposed in the space 34 between the members 18 and 26 is bent so that the curved terminal 12 is generated.

More particularly, the handle 46 is secured to the first end 20 of the first member 18 and the first extremity 28 of the second member 26.

Figure 3:
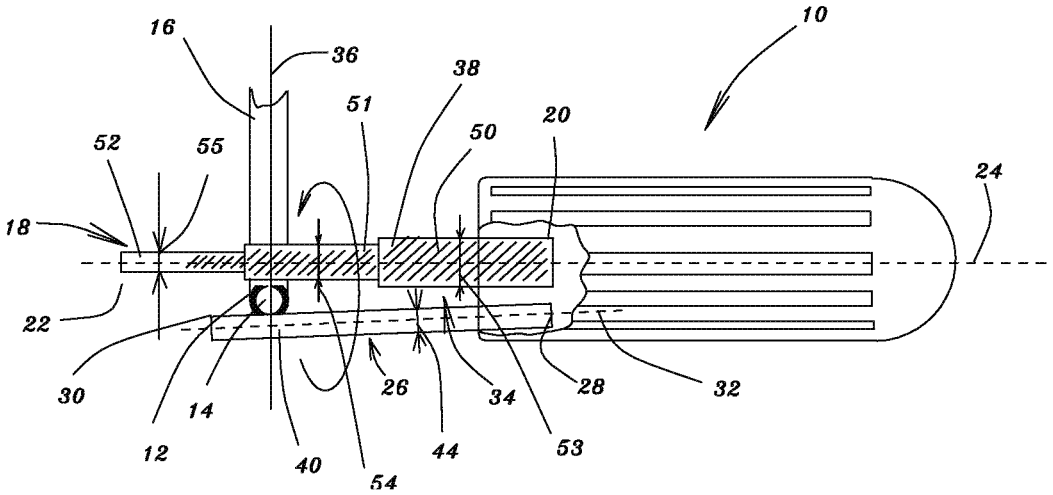
FIG. 3 is a similar view to that shown in FIG. 1 but shows another embodiment of the present invention.

FIG. 3 is a similar view to that shown in FIG. 1 but shows another embodiment of the present invention. As shown in FIG. 3, the first member 18 defines a plurality of cylindrical portions 50, 51 and 52 disposed between the ends 20 and 22 of the first member 18. Each of the plurality of cylindrical portions 50 to 52 has a different diameter 53, 54 and 55 respectively and the plurality of cylindrical portions 50 to 52 are disposed axially spaced relative to each other and coaxially with the longitudinal axis 24. The arrangement is such that the space 34 between the members 18 and 26 accommodates the insulation stripped ends of various gauge electrical wires.

Figure 4:
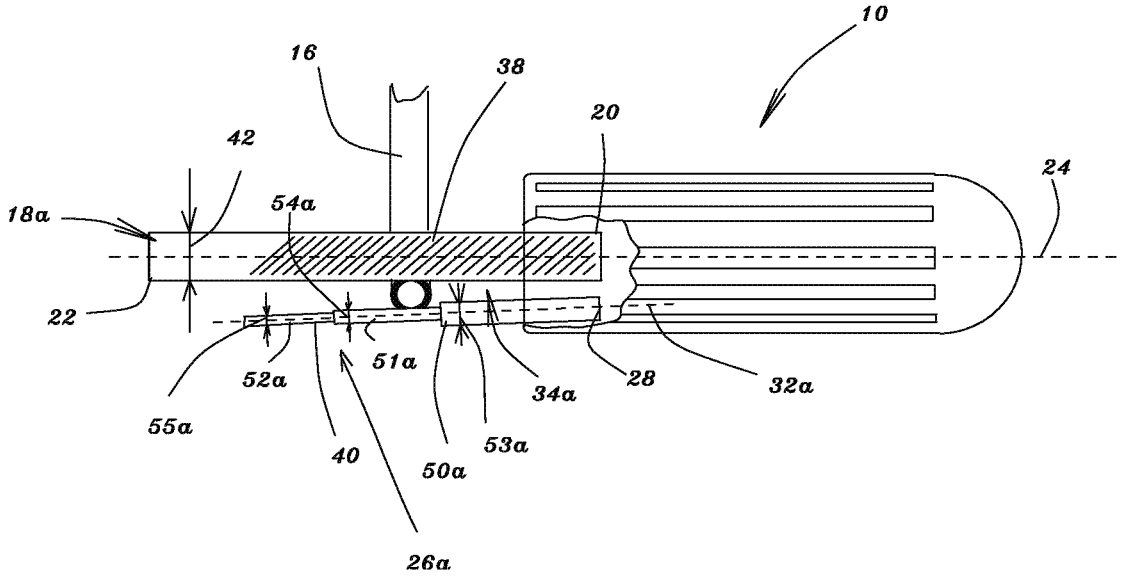
FIG. 4 is a similar view to that shown in FIG. 1 but shows an alternative embodiment of the present invention.

FIG. 4 is a similar view to that shown in FIG. 1 but shows an alternative embodiment of the present invention. As shown in FIG. 4, the second member 26 defines a plurality of cylindrical further portions 50*a*, 51*a* and 52*a* disposed between the extremities 28 and 30 of the second member 26. Each of the plurality of cylindrical further portions 50*a* to 52*a* has a different diameter 53*a*, 54*a* and 55*a* and the plurality of cylindrical further portions 50*a* to 52*a* are disposed axially spaced relative to each other and coaxially with the further longitudinal axis 32*a*. The arrangement is such that the space 34*a* between the members 18*a* and 26*a* accommodates the insulation stripped ends 14 of various gauge electrical wires 16.

Figure 5:
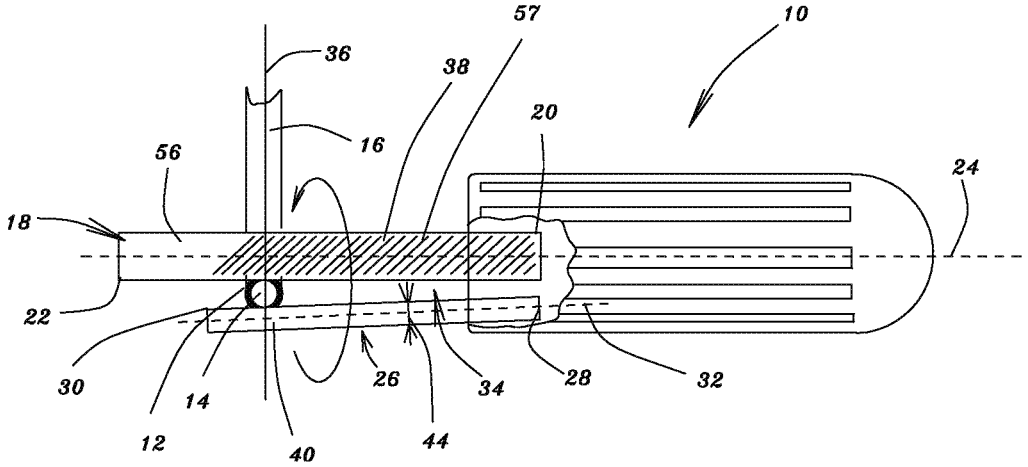
FIG. 5 is a similar view to that shown in FIG. 1 but shows a further embodiment of the present invention.

FIG. 5 is a similar view to that shown in FIG. 1 but shows a further embodiment of the present invention. As shown in FIG. 5, the first member 18 defines a surface 56 which is roughened as indicated by the shading 57 so that the surface 56 of the first member 18 tends to grip the insulation stripped end 14 of the electrical wire 16 during the generation of the curved terminal 12.

Figure 6:
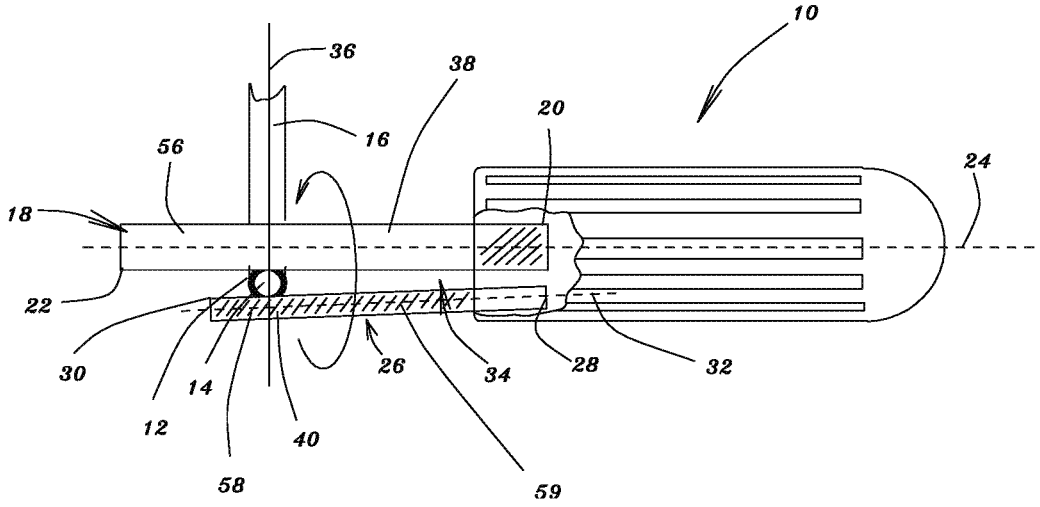
FIG. 6 is a similar view to that shown in FIG. 1 but shows a further embodiment of the present invention.

FIG. 6 is a similar view to that shown in FIG. 1 but shows a further embodiment of the present invention. As shown in FIG. 6, the second member 26 defines a face 58 which is roughened as indicated by shading 59 so that the face 58 of the second member 26 tends to grip the insulation stripped end 14 of the electrical wire 16 during the generation of the curved terminal 12.

Figure 7:
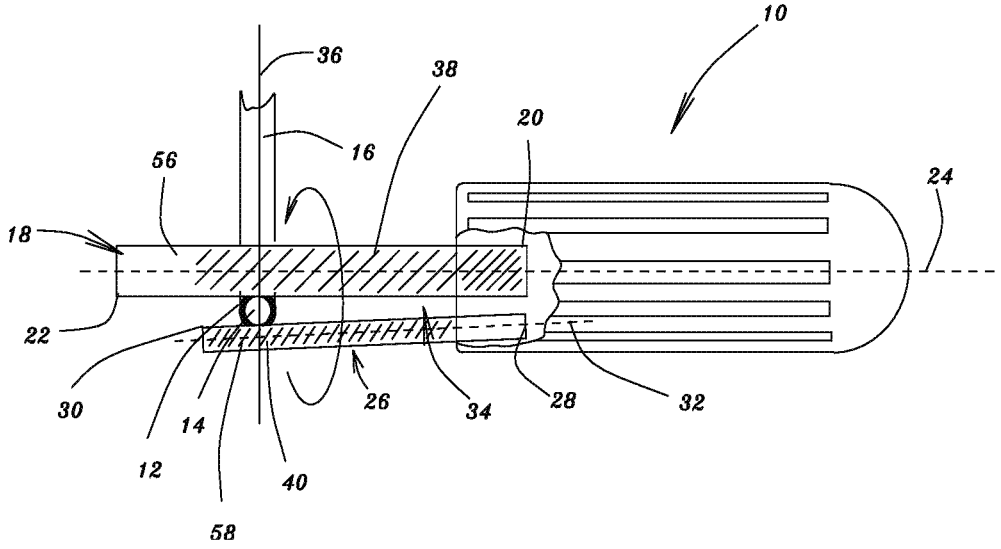
FIG. 7 is a similar view to that shown in FIG. 1 but shows a further embodiment of the present invention.

A FIG. 7 is a similar view to that shown in FIG. 1 but shows a further embodiment of the present invention. As shown in FIG. 7, both the roughened surface 56 and the roughened face 58 grip the insulation stripped end 14 of the electrical wire 16 during the generation of the curved terminal 12.

The concept of the present invention is particularly useful when combined with a screw driver so that the user thereof may screw the generated terminal 12 to a power socket or the like.

Figure 8:
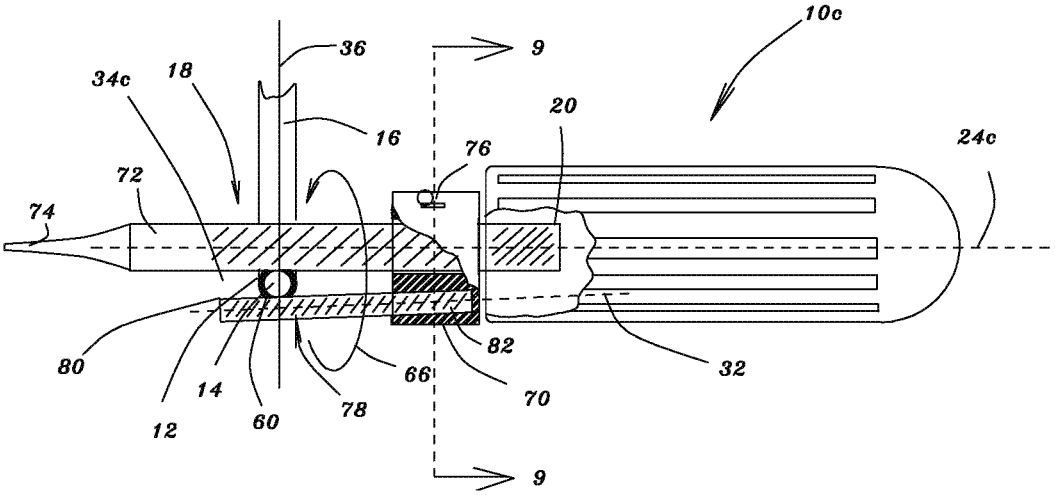
FIG. 8 is a similar view to that shown in FIG. 1 but shows a tool device retro fitted to a screw driver.

In this regard, FIG. 8 is a similar view to that shown in FIG. 1 but shows a tool device retro-fitted to a screw driver. As shown in FIG. 8, the retrofit tool device 10*c* includes a collar 70 which slides axially over a shaft 72 of a screw driver 74. The collar is rigidly 70 is secured to the shaft 72 by a locking mechanism 76. Accordingly, the shaft 72 serves the same purpose as the first member 18 shown in the embodiments shown in FIGS. 1 to 7. A second member 78 extends almost parallel to a longitudinal axis 24*c* of the shaft 72 so that a space 34*c* is defined between the shaft 72 and the second member 78. As shown, the distal extremity 80 of the second member 78 is spaced slightly further away from the shaft 72 than the proximal extremity 82 of the second member 78 for accommodating wires of a different gauge.

Figure 9:
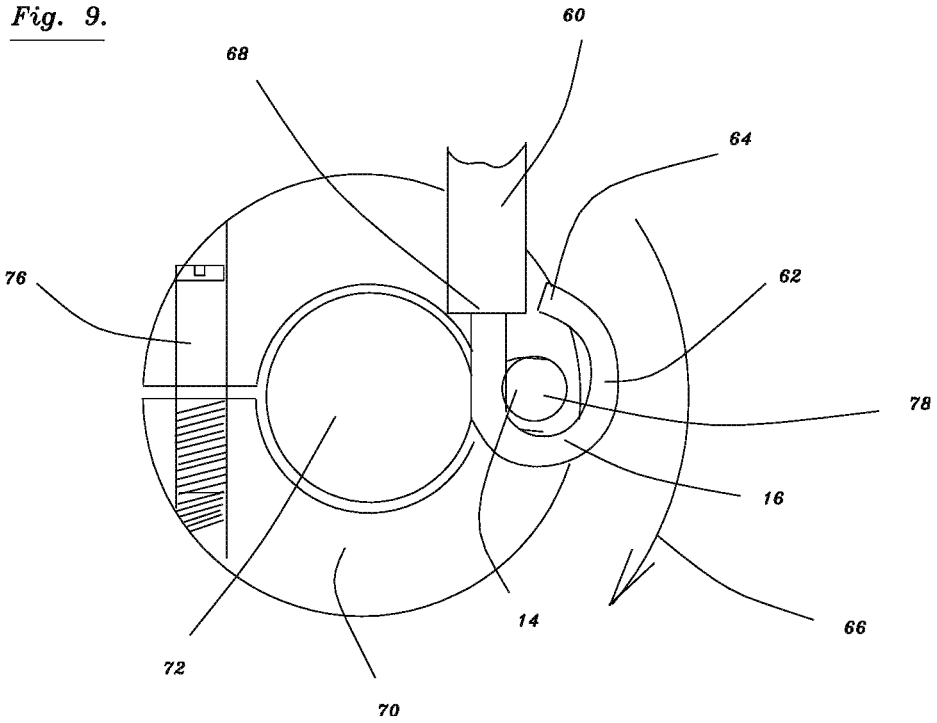
FIG. 9 is an enlarged sectional view taken on the line 9-9 of FIG. 8.

FIG. 9 is an enlarged sectional view taken on the line 9-9 of FIG. 8. As shown in FIG. 9, the end 14 of the wire 16 is located between the shaft 72 (first member) and the second member 78 so that when the shaft 72 is turned as indicated by the arrow 66, the collar 70 clamped to the shaft 72 by the locking mechanism 76 will move the second member 78 and the shaft 72 relative to the wire 16 so that the distal end 64 of the wire 16 is formed into a curver terminal or looped terminal.

In operation of the tool device 10 according to the present invention, the insulation 60 is stripped from the end of the electrical wire 16 and the stripped end 14 of the wire 16 is positioned in the space 34 between the members 18 and 26. When the handle 46 is twisted or turned relative to the stripped end 14 of the wire 16 as indicated by the arrow 48, the members 18 and 26 interact with the end 14 of the wire 16 to generate a curved terminal 12.

Furthermore, if the user of the tool 10 wishes to generate a looped terminal 62 to the end 14 of the wire 16, the distal end 64 of the wire 16 is moved as indicated by the arrow 66 a little further away from the members 18 and 26 (72 and 78) so that the members 18 and 26 are closer to the insulation 60. Further twisting or rotating of the handle 46 as indicated by the arrow 46 will generate a longer curved terminal 12 that will result in the generation of a looped terminal in which the distal end 64 of the stripped end 14 of the wire 16 will be disposed adjacent to the juncture 68 of the insulation 60 and the stripped end 14 of the wire 16 as shown in FIG. 9. Additionally, the curved terminal 12 or looped terminal 62 can subsequently be rotated through 90 degrees relative to the members 18 and 26 so that the terminal 12 or 62 will be disposed at a right angle relative to the juncture 68 for further facilitating attachment of the terminal 12 or 62 to the desired connection point of the electrical socket or switch or the like (not shown).

APPENDIX

10. tool device
12. curved terminal
14. insulation stripped end
16. electrical wire
18. first member
20. first end of 18
22. second end of 18.
24. longitudinal axis
26. second member.
28. first extremity of 26.
30. second extremity of 26.
32. further longitudinal axis.
34. space.
36. plane.
38. portion.
40. further portion.
42. first diameter.
44. second diameter.
46. handle.
48. arrow.
50. first plurality of cylindrical portions.
51. first plurality of cylindrical portions.
52. first plurality of cylindrical portions.
53. diameter of 50.
54. diameter of 51.
55. diameter of 52
56. surface.
58. face.
60. insulation.
62. looped terminal.
64. distal end of 16.
66. arrow.
68. juncture.
70. collar.
72. shaft.
74. screw driver.
76. locking mechanism.
78. second member.
80. distal extremity.
82. proximal end.

What is claimed is:

1. A tool device for generating a curved terminal from an insulation stripped end of an electrical wire, said tool device comprising:

a first member having a first and a second end, said first member having a longitudinal axis;

a second member disposed adjacent to said first member, said second member having a first and a second extremity, said second member defining a further longitudinal axis which diverges from said longitudinal axis in a direction from said first towards said second extremity, said second member being disposed rigidly spaced from said first member such that a diverging space is defined between said first member and said second member for the reception and accommodation therein of the insulation stripped end of any gauge electrical ware, for accommodating wires of a different gauge so that the curved terminal is generated during relative movement of said axes around the insulation stripped end of the electrical wire;

a collar removably secured to said first member; and said second, member extending from said collar.

2. A tool device as set forth in claim 1 wherein said first member includes:

a portion disposed adjacent to and spaced from said second member, said portion being of cylindrical configuration.

3. A tool device as set forth in claim 1 wherein said portion is disposed between said first and said second end of said first member.

4. A tool device as set forth in claim 3 wherein said second member includes:

a further portion disposed adjacent to and spaced from said first member, said further portion being of cylindrical configuration said portion and said further portion cooperating with each other and the insulation stripped end of the electrical wire therebetween.

5. A tool device as set forth in claim 4 wherein said cylindrical portion has a first diameter;

said cylindrical further portion has a second diameter.

6. A tool device as set forth in claim 5 wherein said first and said second diameters are different relative to each other.

7. A tool device as set forth in claim 4 wherein said portion defines a surface which is roughened;

said further portion defines a face which is roughened so that said roughened surface and said roughened face tend to grip the insulation stripped end of the electrical wire during the generation of the curved terminal.

8. A tool device as set forth in claim 1 wherein said first member and said second member are fabricated from steel.

9. A tool device as set forth in claim 1 further including:

a handle secured to said first member such that when said handle is rotated, said first member and second member move relative to each other such that the insulation stripped end of the electrical wire disposed in said space is bent so that the curved terminal is generated.

10. A tool device as set forth in claim 9 wherein said handle is secured to said first end of said first member.

11. A tool device as set forth in claim 1 wherein said space defined between said first member and said second member is tapered for the reception therein of the insulation stripped end so that said space accommodates the insulation stripped ends of various gauge electrical wires.

12. A tool device as set forth in claim 1 wherein said first member includes:

a portion disposed adjacent to and spaced from said second member, said portion being of cylindrical configuration;

said portion being, disposed between, said first end and said second end of said first member:

said second member including:

a further portion disposed adjacent to and spaced from said first member, said further portion being of cylindrical configuration;

said further portion being disposed between said first and said second extremity of said second member;

said cylindrical portion having a first diameter;

said further portion having a second diameter;

said first and said second diameters being different relative to each other;

said first member and said second member being fabricated from steel;

a handle secured to said first member such that when said handle is rotated, said first member and second member move relative to each other such that the insulation stripped end of the electrical wire disposed in said space is bent so that the curved terminal is generated;

said handle being secured to said first end of said first member;

said portion defining a surface which is roughened; and said further portion defining a face which is roughened so that said surface and said face grip the insulation stripped end of the electrical wire during the generation of the curved terminal.

* * * * *